United States Patent [19]

Jones et al.

[11] Patent Number: 4,911,041

[45] Date of Patent: Mar. 27, 1990

[54] E-Z LINER

[76] Inventors: Michael P. Jones, 1800 Lakewood Dr., Apt. X-2; John P. Jones, 2905 Fourth Ave., both of Phenix City, Ala. 36867

[21] Appl. No.: 312,482

[22] Filed: Feb. 21, 1989

[51] Int. Cl.[4] ..... B25B 33/00

[52] U.S. Cl. ..... 81/487; 29/271

[58] Field of Search ..... 81/177.6, 180.1, 184, 81/487, 488; 29/271

[56] References Cited

U.S. PATENT DOCUMENTS

| | | | |
|---|---|---|---|
| 2,691,908 | 10/1954 | Lamberth | 81/487 |
| 2,889,726 | 6/1959 | Strabeck | 81/487 |
| 3,023,649 | 3/1962 | Wallace | 81/487 |
| 3,863,307 | 2/1975 | Leonardo | 81/487 |
| 4,730,960 | 3/1988 | Lewis et al. | 81/177.6 X |

*Primary Examiner*—James G. Smith

*Attorney, Agent, or Firm*—Michael C. Smith

[57] ABSTRACT

An alignment tool designed for use with flexible cable type screw drivers such as carburetor adjusting tools, comprising a rigid tool which is fixed to the end of a screw driver type handle and shaft, the rigid tube has a spiral shaped slot formed therein so that a flexible cable may be rolled through the slot into the center of the tube.

3 Claims, 2 Drawing Sheets

E-Z LINER

TECHNICAL FIELD

The present invention relates generally to tools, and specifically to an alignment tool for use with flexible cable drivers.

BACKGROUND ART

Tool holders are well known in the art. Examples are shown in U.S. Pat. Nos. 2,691,908; 2,889,726; 3,023,649 and 3,863,307. Tools with flexible portions are also well known, for example that shown in U.S. Pat. No. 4,730,960.

While the varieties of tool holders and flexible tools are apparently well suited for their particular tasks, until the present invention there has been no alignment tool for use with flexible cable drivers to allow for positioning of a needed portion of the flexible cable driver in a desired alignment. It is for this reason that the present alignment tool was invented.

DISCLOSURE OF INVENTION

The present invention promotes efficient use of a flexible tool. The present invention is an alignment tool designed for use with flexible cable type screw drivers, such as carburetor adjusting tools. The alignment tool comprises a tube with a spiral slot inscribed therein, mounted on the end of a screw driver type handle and shaft. When using the alignment tool, a mechanic rolls the flexible cable throught the slot in the tube so that the flexible cable is inside the tube. Once inside the tube, the mechanic uses the alignemnt tool to position the flexible cable adjusting tool into hard to reach places.

Thus, a primary object of the present invention is to provide an alignment tool for use with flexible tools.

Another major object of this invention is to provide an alignment tool for use with flexible cable type screw drivers, such as a carburetor adjusting tool.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with the accompanied drawings in which like parts are given like identification numerals and wherein:

BEST MODE FOR CARRYING OUT THE INVENTION

Figure 1:
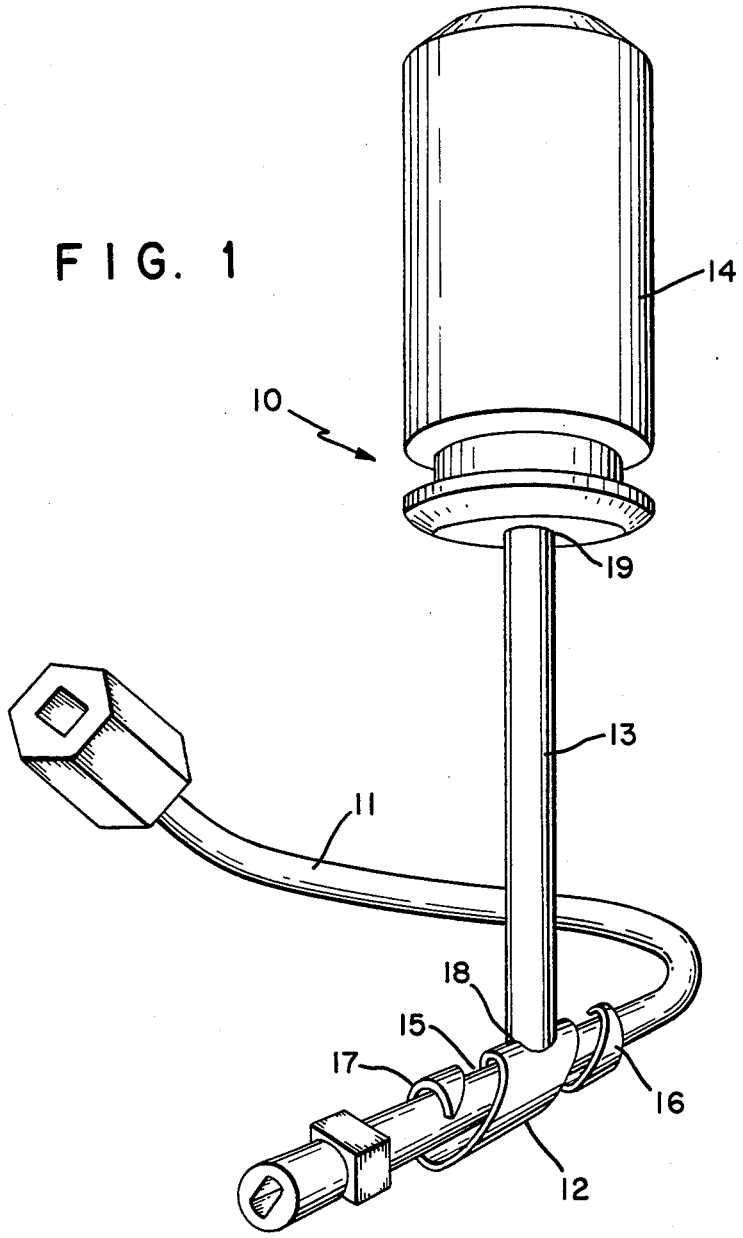
FIG. 1 is a perspective view of the present invention as used with a flexible driver tool.

As FIG. 1 of the drawings illustrates, the preferred embodiment of the present invention is illustrated generally at 10 in cooperation with a flexible driver tool 11. The alignment tool 10 has a tubular member 12 having a longitudinal axis with a spiral slot 15 concentric with the longitudinal axis. It has a shaft 13 attached to the mid portion of the tubular member 12 and extends perpendicular to the longitudinal axis. A handle 14 is attached to the shaft 13 at an end 19 opposite from the point of attachment 18 of the shaft 13 to the tubular member 12. A flexible cable driver 11 may be rolled into the spiral slot 15 and the alignment tool 10 then used as a guide for proper placement of the driver 11. The slot 15 may have a constant width, or it may have a variety of widths throughout its length to accomodate different size driver cables.

The alignment tool 10 is designed for use with a flexible cable type screw driver such as the carburetor adjusting tool 11. The operative component of the alignment tool 10 is a rigid tube 12 rigidly secured to a screw driver type shaft 13 and handle 14. The tube 12 is preferably metal. The design of the metal tube 12 may vary in order to accommodate different size cable and in order to make the alignment tool 10 removable from or permanently attached to the flexible cable type adjusting tool 11.

Figure 2:
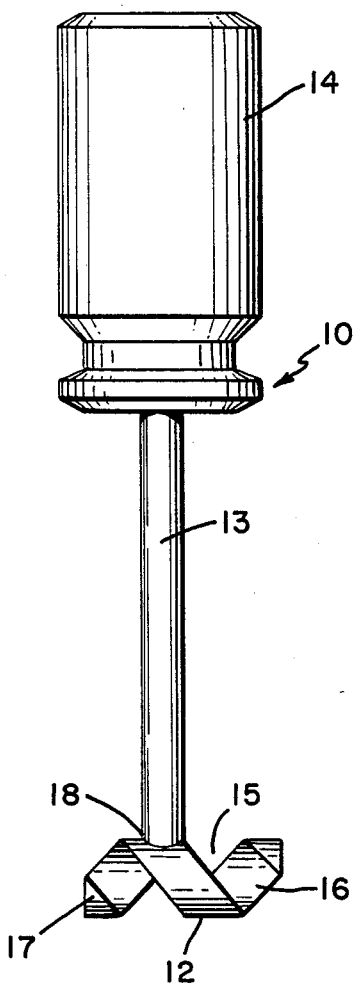
FIG. 2 is a side view of an embodiment of the present invention for removable use with a flexible tool.

For example, FIG. 2 shows the alignment tool 10 as designed for use with a 3/16 inch flexible cable adjustment tool 11. In FIG. 2, the mental tube 12 has a spiral shaped slot 15 one fourth of an inch in width leaving a metal ribbon 16 one fourth of an inch in width. The tube 12 is one inch in length and has a 3/8 inch outside diamenter. The tube wall 17 is 1/32 inch thick. The screw driver handle 14 and shaft 13 are rigidly fixed to the tube 12 near the lengthwise center of the tube 12. Tube 12 is secured to an end 18 of shaft 13 away from handle 14 and is generally perpendicular to the shaft 13.

Figure 3:
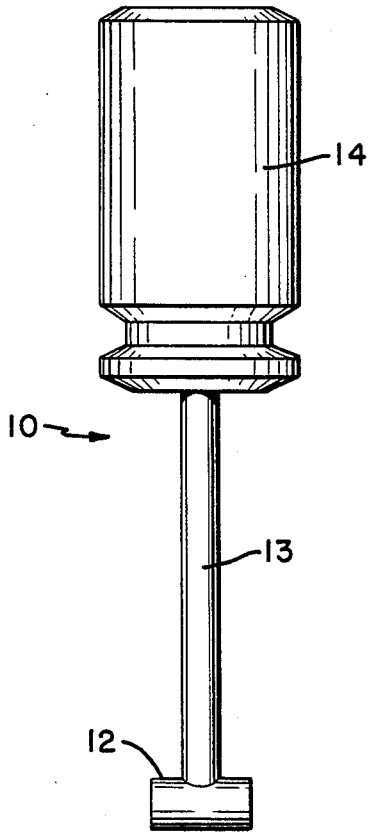
FIG. 3 is a side view of an embodiment of the present invention permanently secured to a flexible tool.

FIG. 3 shows the alignment tool 10 as designed for use with and permanent attachment during manufacture to a 1/8 inch cable type adjustment tool 11. The tube 12 has no spiral slot. The screw driver type shaft 13 is secured near the lengthwise center of the tube 12 generally perpendicular thereto.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitation in the tool manufacturing industry and is particularly useful in the automobile tool manufacturing industry.

I claim:

1. An alignment tool for use with flexible cable drivers comprising:

a tubular member having a longitudinal axis with a spiral slot concentric with the said longitudinal axis;

a shaft attached to a mid portion of said tubular member and extending perpendicular to the longitudinal axis, a handle attached to said shaft at an end opposite from the point of attachment of said shaft to said tubular member;

said flexible cable driver being rolled into the spiral slot and the alignment tool being used as a guide for proper placement of the driver.

2. The alignment of tool of claim 1 wherein the width of the spiral slot is constant throughout its length.

3. The alignment tool of claim 1 wherein the width of the spiral slot varies throughout its length so as to accommodate different size driver cables.

* * * * *